US005335632A

United States Patent [19]

Hefley

[11] Patent Number: 5,335,632

[45] Date of Patent: Aug. 9, 1994

[54] VARIABLE COMPRESSION INTERNAL COMBUSTION ENGINE

[76] Inventor: Carl D. Hefley, 1804 N. Evergreen St., Burbank, Calif. 91505

[21] Appl. No.: 61,013

[22] Filed: May 14, 1993

[51] Int. Cl.[5] ..... F02B 75/12

[52] U.S. Cl. ..... 123/48 B; 123/78 E

[58] Field of Search ..... 123/78 E, 48 B, 78 F

[56] References Cited

U.S. PATENT DOCUMENTS

| | | | |
|---|---|---|---|
| 1,912,604 | 6/1933 | Valentin | 123/48 B |
| 2,873,611 | 2/1959 | Biermann | 123/48 B |
| 2,909,163 | 10/1959 | Biermann | 123/48 B |
| 2,909,164 | 10/1959 | Biermann | 123/48 B |
| 5,136,987 | 8/1992 | Schechter et al. | 123/78 E |

*Primary Examiner*—Tony M. Argenbright
*Assistant Examiner*—M. Macy
*Attorney, Agent, or Firm*—Arant, Gene W.; Michael J. Ram

[57] ABSTRACT

Controlled variation of piston .displacement and adjustment of compression ratio are achieved by an adjustment mechanism located between the vehicle crank shaft and the piston which changes the effective length of the piston rod. The piston rod is divided into upper and lower portions and the adjustment mechanism connected to both portions at the point of division. The adjustment mechanism allows controlled lateral displacement of the two parts of the piston rod from each other at the point of division while still transmitting energy of motion from the piston to the crank shaft.

9 Claims, 5 Drawing Sheets

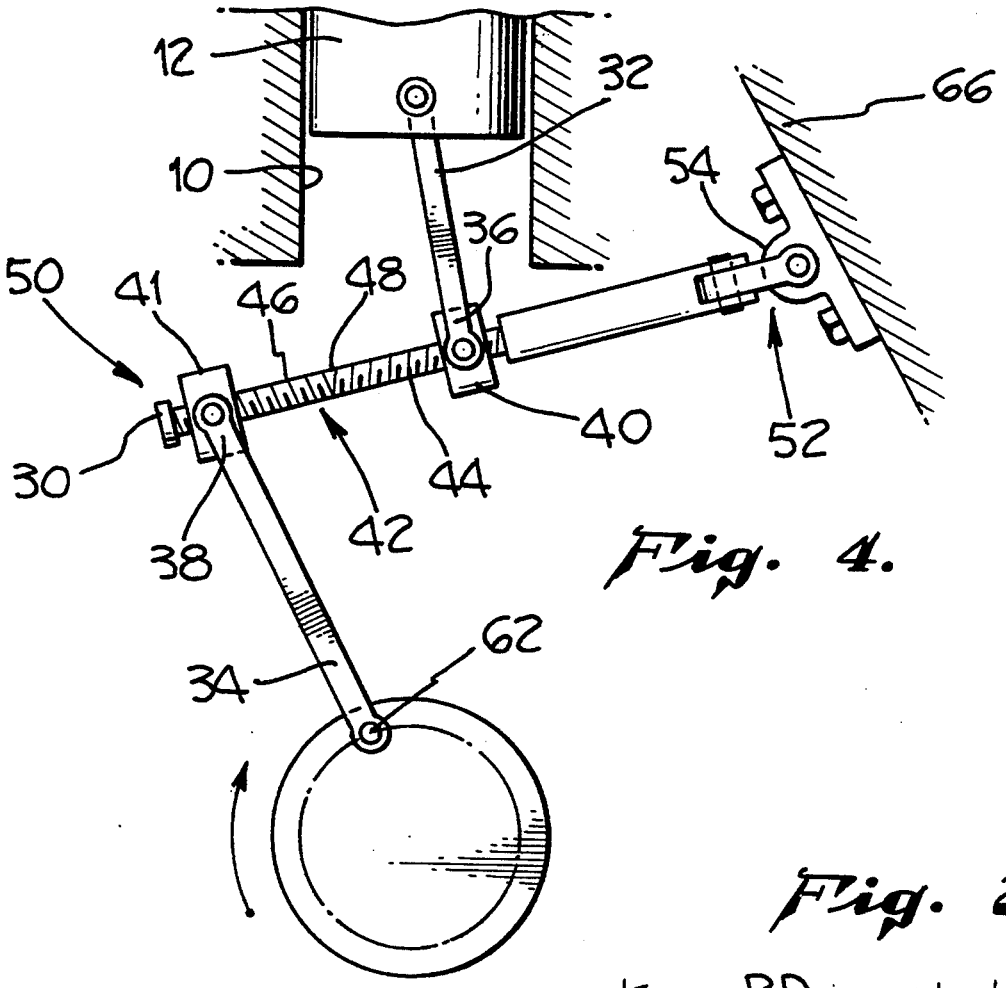
Fig. 4.
Fig. 2.
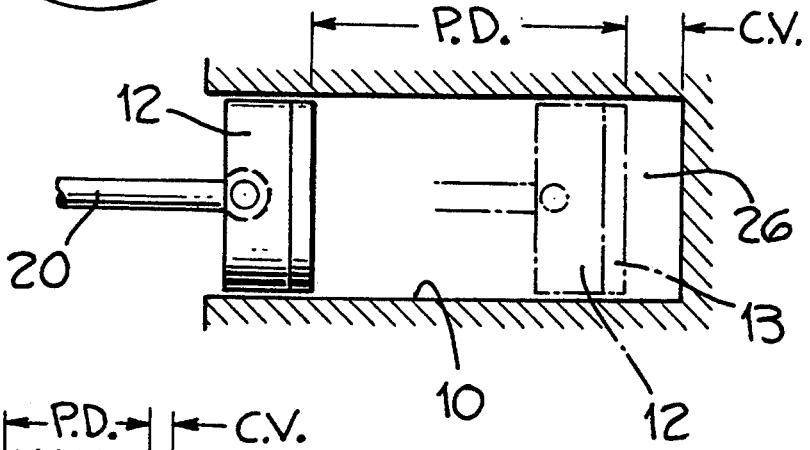
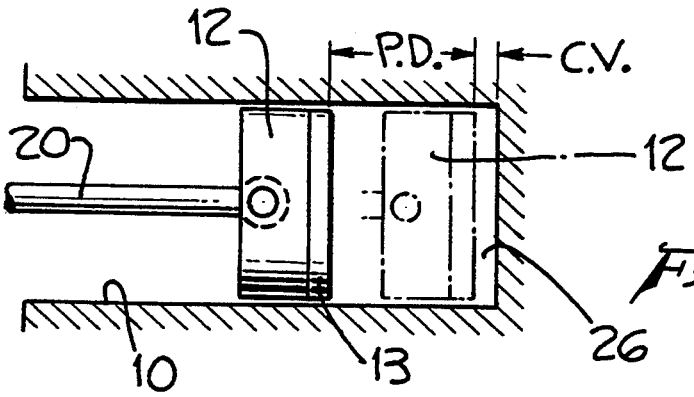
Fig. 3.

VARIABLE COMPRESSION INTERNAL COMBUSTION ENGINE

BACKGROUND

The present invention relates to an internal combustion engine with reduced fuel consumption and increased power and efficiency.

Experience has shown that varying the piston displacement in an internal combustion engine to match load requirements can result in substantial fuel savings. Additionally, adjusting the displacement ratio as the load changes can result in further advantages.

The conventional reciprocating combustion engine uses a piston to compress a working fluid in a cylinder chamber. The fluid is then ignited by a spark and the resultant explosion drives the piston a fixed distance along the length of the cylinder. The energy generated by the ignition, and the subsequent linear movement of the piston, is transmitted through a piston rod which is connected to a rotating crank shaft, by way of bearings or other connection means which allow a pivotal connection to the piston on one end and the crank shaft on the other.

The conventional internal combustion engine is designed so that peak power and efficiency is available when the engine operates at full load. As a result, operation of the engine at partial load results in a reduced efficiency. When a conventional engine is operated at less than full load less power is needed and, therefore, the power output is reduced by throttling back the air-fuel mixture. This reduces the pressure in the cylinder and increases the residual gas content following combustion, thus resulting in decreased operating efficiency.

The preferred approach to increase efficiency is to adjust the piston displacement or stroke length to obtain the maximum power requirement for each operating regime while maintaining the engine at full throttle. This may be done by maintaining a fixed compression ratio or further improved by adjusting the compression ratio while the displacement is being varied. Reducing the length of the piston stroke will also reduce friction, thus additionally improving efficiency.

The prior art shows various mechanisms and linkage arrangements for varying the stroke length and compression ratio. However, these designs have not been successfully commercialized, most likely because they were complicated, unreliable or mechanically inoperable.

Thus, there is a need for a simple, readily adjustable mechanical arrangement which will allow for controlled variation of piston displacement and, if desired, adjustment of compression ratio as the power demand of an engine changes.

SUMMARY

According to the present invention, this need is met by adjustment means located between the vehicle crank shaft and the piston which allows a controlled change of the effective length of the piston rod (the shaft to piston connection). This is accomplished by dividing the piston rod into upper and lower portions with the adjustment means connected to the upper and lower portions at the point of division. The adjustment means comprises a mechanism which allows controlled lateral displacement of the two parts of the piston rod from each other at the point of division while still transmitting the energy of motion from the piston to the crank shaft.

The rod connecting the piston to the crank shaft is divided into two pieces, preferably approximately at its center, into top and bottom parts, and the adjacent ends of the top and bottom parts of the divided rod are affixed to the adjustable mechanism through pivotal or adjustable linkages. Manipulation of the adjustment means in response to preselected engine operating conditions causes the adjacent ends of the top and bottom portions of the piston rod to move closer together or further apart. This movement causes a change in the effective length of the piston rod which, in turn, increases or decreases the extent of the piston movement and, as a result, varies the cylinder displacement.

When the top and bottom ends are adjacent to each other the engine operates as if the piston rod is in one piece, i.e., like an unmodified engine. However, using the adjustment mechanism to move the top and bottom portions of the piston rod apart decreases the length of the piston stroke and thus the displacement and power output.

DRAWINGS

These and other features, aspects and advantages of the present invention will become better understood from the following description, appended claims, and accompanying drawings where:

FIG. 2 is a schematic diagram showing the relationship between clearance volume and piston displacement for a long stroke setting.

FIG. 3 is a schematic diagram showing the relationship between clearance volume and piston displacement for a short stroke arrangement having the same compression ratio as the arrangement of FIG. 2.

FIG. 4 is a schematic, cross-sectional view of a first piston rod adjustment means according to the present invention.

DESCRIPTION

In the figures, similar parts of the different versions are numbered with the same numeral.

Figure 1:
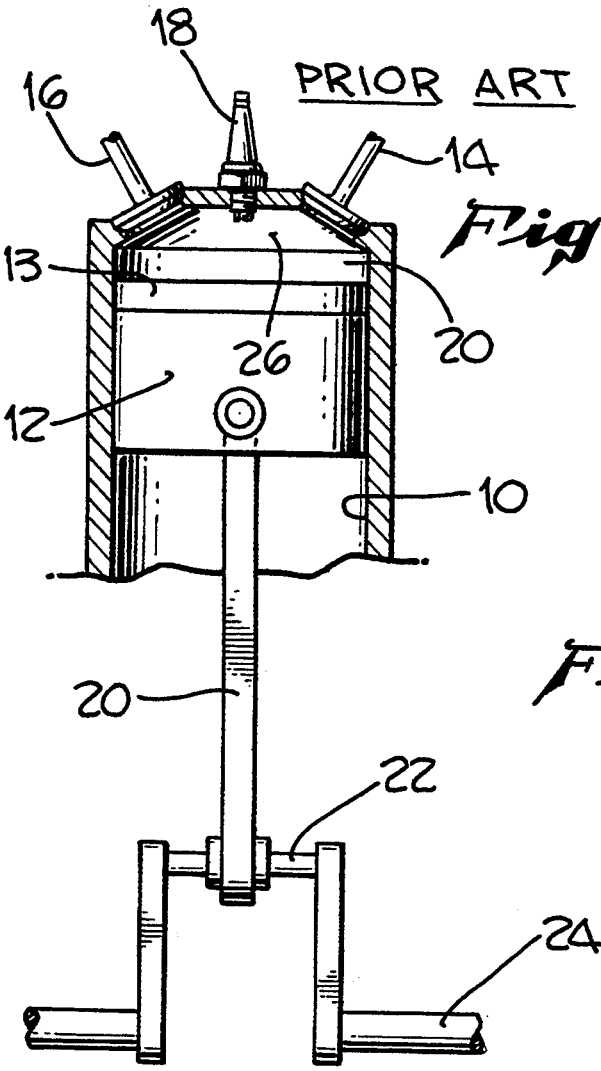
FIG. 1 is a schematic, cross-sectional diagram of a conventional piston arrangement of the prior art.

FIG. 1 shows a single cylinder 10 and piston 12 arrangement of a prior art, conventional, reciprocal, internal combustion engine at the beginning of the fuel intake stroke or after compression of the fuel mixture. The cylinder also includes an intake valve 14, an exhaust valve 16, and a spark plug 18. A piston rod 20 has one end pivotally connected through a conventional piston pin to the piston 12 and has its other end pivotally connected to a raised journal 22 of a crank shaft 24. In operation, the intake valve 14 opens as the crank shaft 24 rotates, drawing the piston 12 along the cylinder 10 to its maximum withdrawn position (see FIG. 2). The intake valve 14 is then closed, the air-fuel mixture introduced into the head space 26 is compressed as the crank shaft 24 completes its 360° rotation, and the air-fuel mixture is ignited by a spark from the spark plug 18. The expanding gas resulting from the ignition of the air-fuel mixture drives, the piston 12 along the cylinder 10 causing the crank shaft to rotate through some or all of a 180° arc. The same procedure is repeated in other cylinders of the engine but at somewhat different times, supplying the energy to complete the rest of the 360° rotation of the shaft.

The meanings of the various terms used in this specification are best shown by reference to FIGS. 2 and 3. FIG. 2 shows a piston 12 located in a cylinder 10 with the piston 12 withdrawn to the bottom of the stroke. The dotted lines represent the piston 12 at the top of the stroke. The volume of the head space between the cylinder head 11 and the piston head 13 when at the top of its stroke is referred to as the clearance volume. The difference between the clearance volume and the cylinder volume when the piston is at the bottom of the stroke is referred to as the piston displacement. The ratio of the sum of the piston displacement plus the clearance volume to the clearance volume alone is the compression ratio. FIG. 2 shows an arrangement with a 8 to 1 compression ratio.

FIG. 3 shows a similar arrangement with a shorter piston stroke. In FIG. 3 the piston 12 is positioned at the bottom of the stroke; the dotted lines show the position of the head 13 of piston 12 at the top of the stroke. However, the compression ratio is still 8 to 1 because both the piston displacement and the clearance volume are reduced by half.

Figure 5:
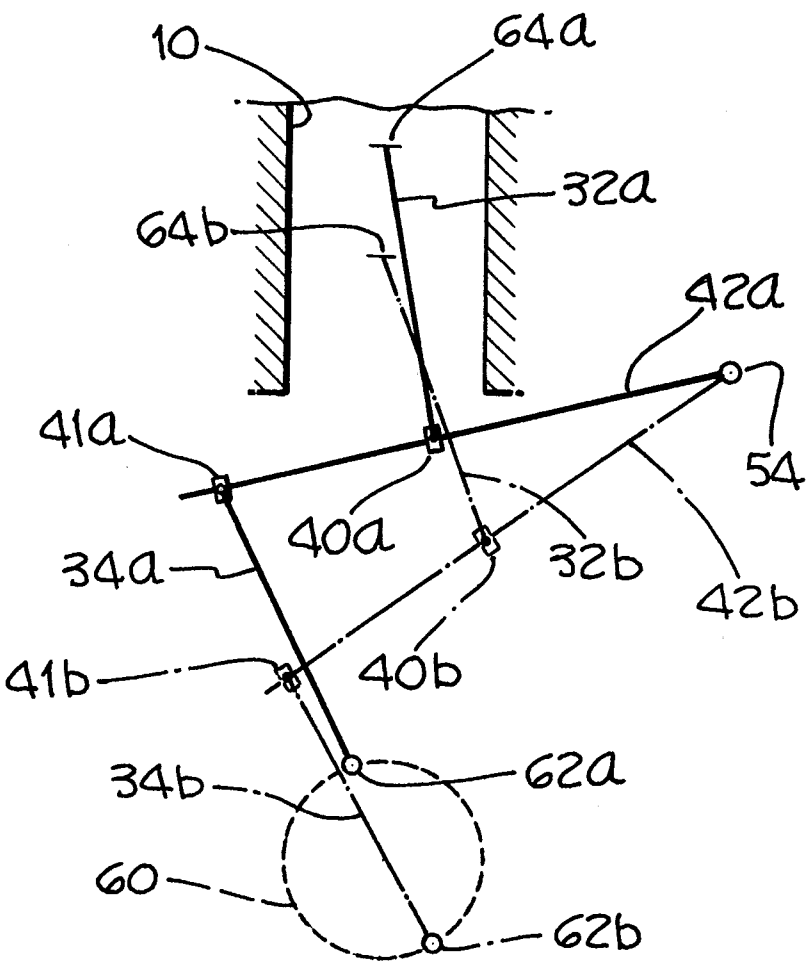
FIG. 5 is a schematic diagram showing the extremes of the piston stroke for the arrangement of FIG. 4 in its short stroke settings.
Figure 6:
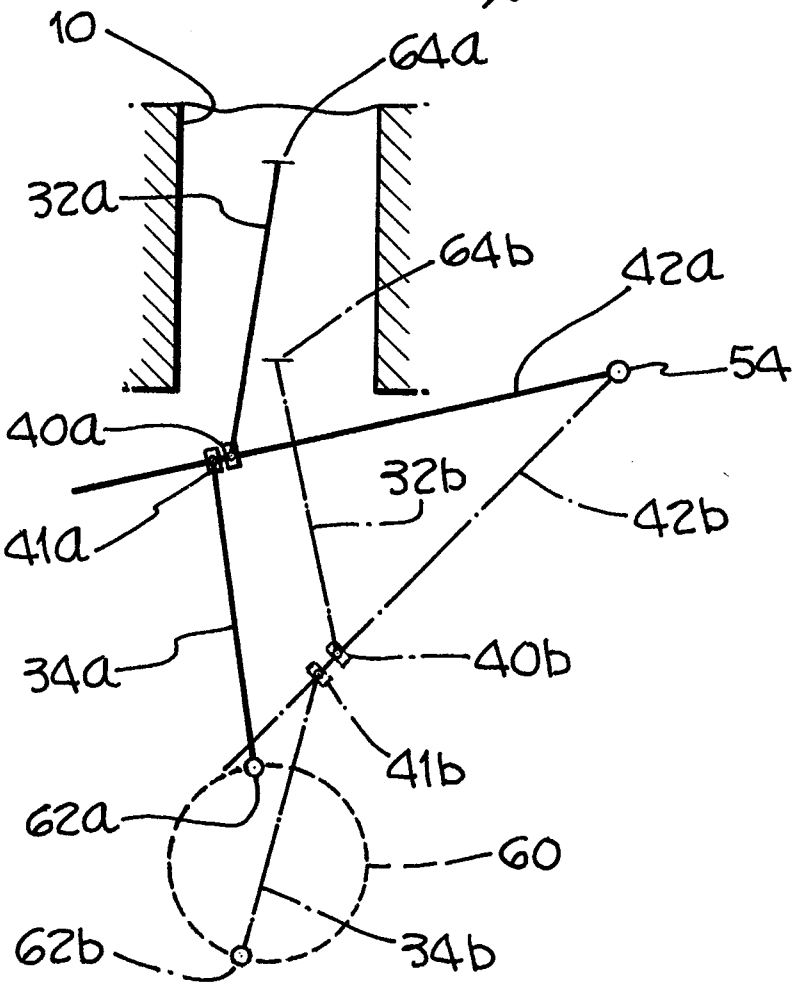
FIG. 6 is a schematic diagram showing the extremes of the piston stroke for the arrangement of FIG. 4 in its long stroke settings.

FIGS. 4 through 6 show a first version of the present invention. A displacement adjustment means 30 for changing the effective length of the piston rod is interposed between the piston 12 and the crank shaft 24 for varying the extent of movement of the piston 12. In place of the piston rod 20 an upper piston rod 32 and a lower piston rod 34 are utilized, the effective combined length of the upper piston rod 32 and the lower piston rod 34 being about the same as or somewhat longer than the piston rod 20 of the prior art devices. The lower end 36 of the upper piston rod 32 and the upper end 38 of the lower piston rod 34 both have shaft riding means (upper and lower shaft riding means 40 and 41) such as roller bearings. The shaft riding means 40 and 41 are movably mounted on the adjustment mechanism 30.

The adjustment mechanism 30 of the version shown in FIGS. 4 through 6 consists of a rotatable member or arm 42 having a right threaded portion 44 and a left threaded portion 46, with the threads on the two portions running in opposite directions, the right and left threaded portions 44 and 46 meeting at junction 48. The left end 50 of the rotatable member 42 is free floating while the right end 52 of the member is pivotally attached to the engine block or frame in fixed relation to both the cylinder and the crank shaft in an intermediate position relative thereto. The attachment is made through a universal joint 54 or other suitable mechanism which is, in turn, operatively connected to control means, not specifically shown, for adjusting the piston displacement as described hereinbelow.

The shaft riding means 40 and 41 mounted on the lower end 36 of the upper piston rod 32 and the upper end 38 of the lower piston rod 34, respectively, are located on the rotatable member 42 and meshed with the threaded right portion 44 and threaded left portion 46 so that rotation of the member 42 causes the two shaft riding means 40 and 41 to move in opposite directions to each other along the member 42. For example, FIG. 4 shows the shaft riding means 40 and 41 positioned as far apart as the system allows. Rotation of the member 42 causes the shaft riding means 40 and 41 to move towards each other until they reach junction 48. The pivotal movements of the upper and lower portions of the piston rod, the pivotal movement of adjustment arm 30, and the lateral movements of the adjacent ends of the two piston rod portions, all occur within the same plane.

FIG. 5 is a schematic diagram of the arrangement shown in FIG. 4 (the short stroke setting). The upper and lower shaft riding means 40 and 41 are positioned as far apart as possible along the rotatable mechanism 42. The circle 60 represents the movement of the crank shaft journal at the junction point 62, where the lower end of lower piston rod portion 34 is pivotally joined to the raised journal 22 of the crank shaft 24. Each of the components is numbered with the same number as in FIG. 4 with the exception that the top of the piston stroke is represented by a numeral followed by the letter "a" and the bottom of the stroke is represented by a numeral followed by the letter "b." Thus, the position of certain relevant components at the top of the stroke is represented by piston head **64*a*, upper piston rod 32*a*, lower piston rod 34*a*, rotatable member 42*a* and pivot junction 62*a*. Likewise, the same components at the bottom of the stroke are represented by 64*b*, 32*b*, 34*b*, 42*b* and 62*b*. In FIG. 4 the volume above the piston head 64*b* at the bottom of the stroke is about eight times the volume above the piston head 64*a*** at the top of the stroke.

FIG. 6 is a schematic diagram of the arrangement of FIG. 4 with the system adjusted to the long stroke settings. Upper shaft riding means 40 and lower shaft riding means 41 are repositioned along the rotatable mechanism 42 so that they are adjacent to the junction 48 (as close as possible to each other). This results in greater movement of the displacement mechanism 30 than in the short stroke setting shown in FIG. 5. As a result, with the dimensions as shown in FIGS. 5 and 6, the length of the piston stroke is increased by about 75%. However, the ratio of the clearance volume at the top and bottom of the stroke remains at about 8 to 1.

One skilled in the art will recognize that there are various different mechanical components that can be substituted for the various parts of the assembly described above. For example, the displacement adjustment mechanism 30 can be composed of rods or interlocking tracks that slide on each other with the upper and lower piston rods 32 and 34 each attached to a different rod or track, the rods or tracks being adjustable in relationship to each other. Additionally, various flexible attachment means can be used to couple the various components together, so that they can rotate, turn, spin, revolve or pivot as may be required for proper mechanical functioning of the assembly.

Figure 7:
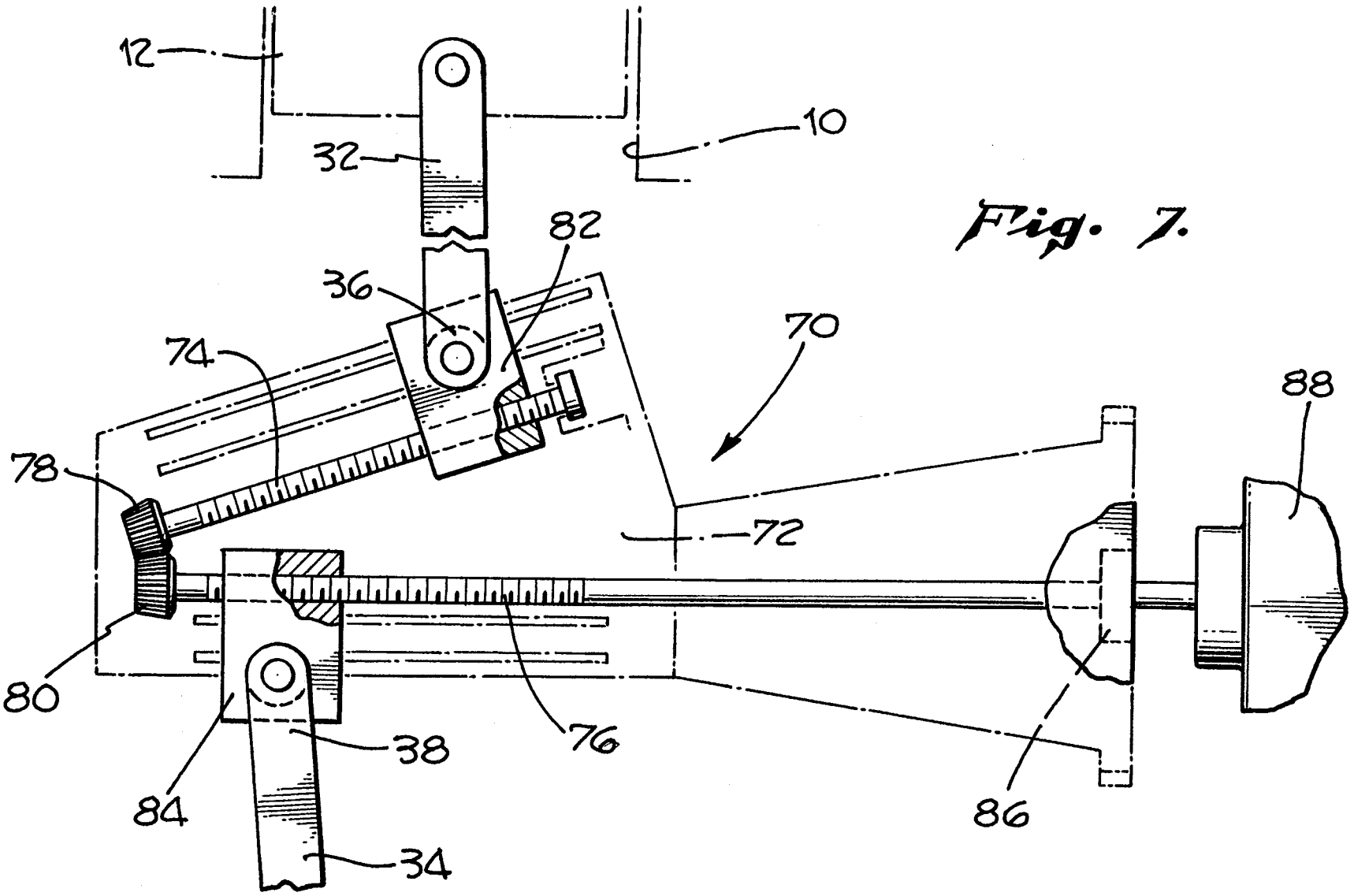
FIG. 7 is a schematic, cross-sectional view of a piston rod adjustment means in accordance with a second embodiment of the invention.

FIG. 7 shows a variation of the system for adjusting the piston displacement using a double worm drive 70 as the displacement mechanism 30. The double worm drive 70 consists of a block 72 which has upper and lower threaded shafts 74 and 76 mounted therein at a fixed angle to each other. The shafts are held within the block so that each can be freely rotated around its central axis. The upper and lower shafts 74 and 76 have respective beveled gears 78 and 80 mounted thereon at the point where the upper and lower shafts 74 and 76 intersect. Additionally, upper and lower worm gear riders 82 and 84 are slidably mounted to the block 72 and the respective upper and lower threaded shafts 74 and 76 so that rotation of the shafts 74 and 76 causes the riders 82 and 84 to traverse along the length of the block 72. The upper and lower gears 78 and 80 intermesh, and rotational motion is imparted to the lower threaded shaft 76 so as to transmit that motion to the upper shaft 74. This whole arrangement is attached to the engine block or suitable frame structure through a flexible linkage 86 which allows the double worm drive 70 to reciprocate as the piston 12 is driven up and down by ignition in the cylinder 10 and allows the lower shaft to be rotated to reposition the upper and lower piston rods 32 and 34.

The angle between the shafts 74 and 76 is not necessarily critical, but can be selected to give the desired range of displacement variation. If shafts 74 and 76 are parallel the double worm drive 70 will function like the variation described above. An angle of 0° to 60° may be selected with 20° to 40° being the preferred range for ease of operation and displacement variation.

Figure 9:
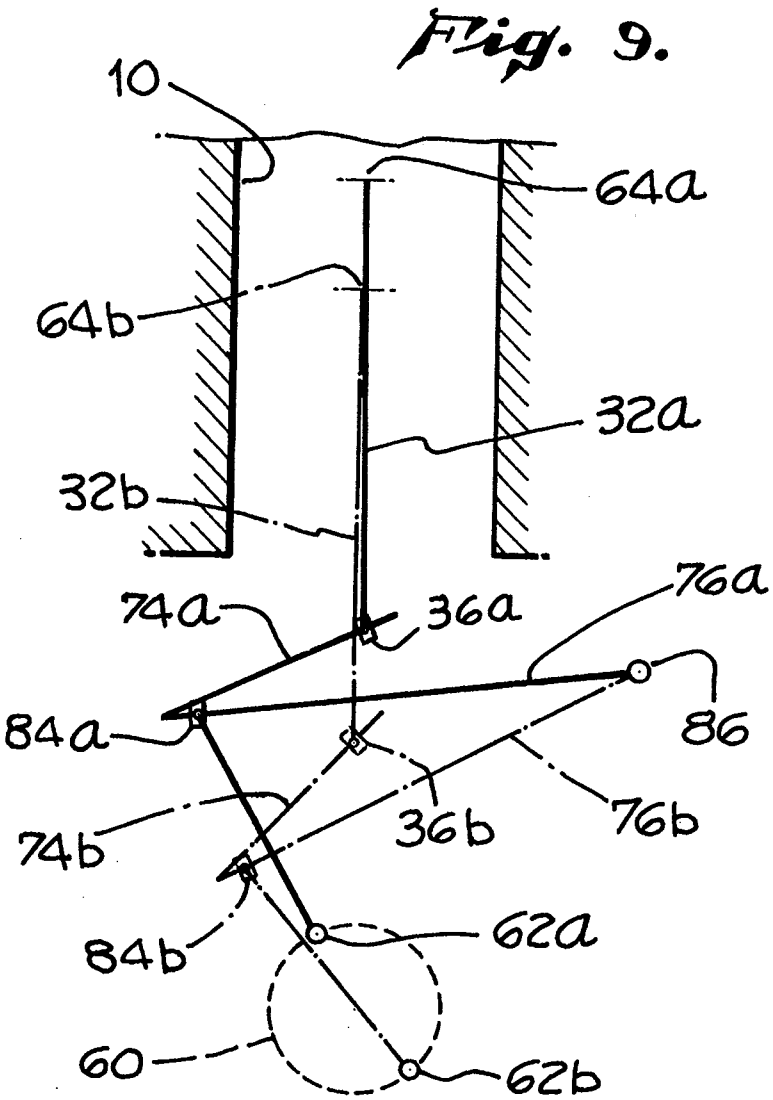
FIG. 9 is a schematic diagram showing the extremes of the piston stroke for the arrangement of FIG. 7 in a short stroke setting.
Figure 8:
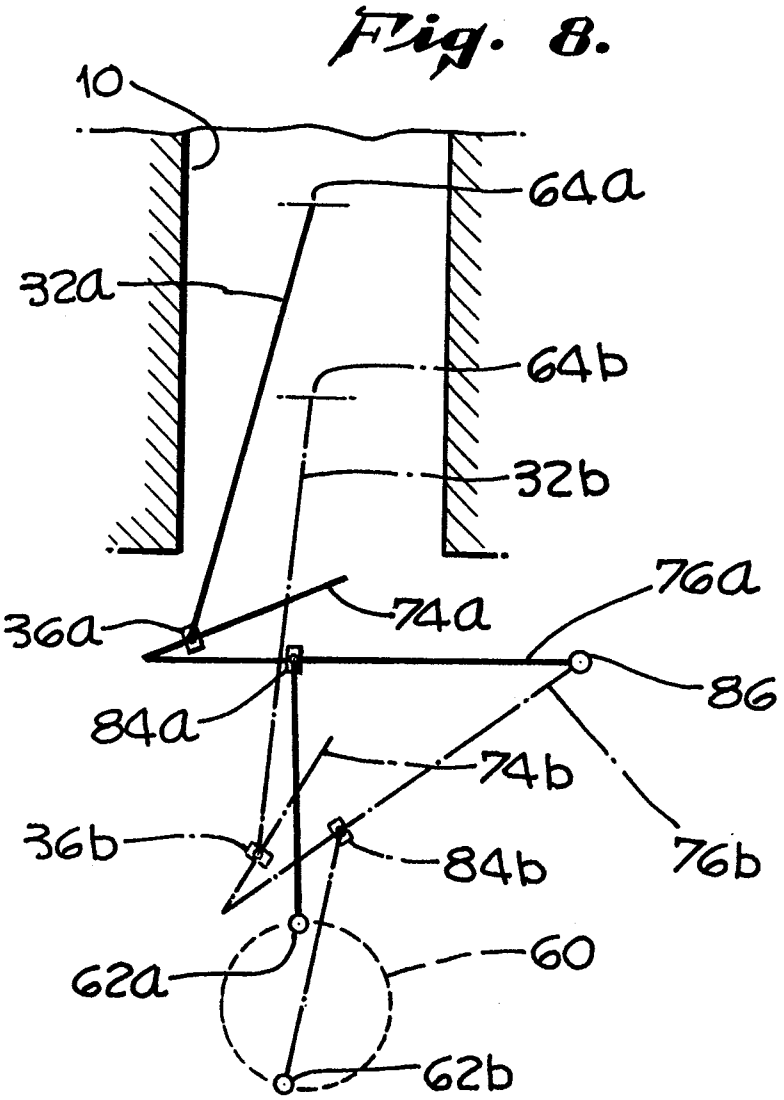
FIG. 8 is a schematic diagram showing the extremes of the piston stroke for the arrangement of FIG. 7 in a long stroke setting.

FIGS. 8 and 9 schematically show the effect of adjusting the position of the upper and lower worm riders 82 and 84 along the threaded shafts 74 and 76 to vary the displacement of the piston 12 in the cylinder 10. The components of FIGS. 8 and 9 are labeled in the same manner as FIGS. 3 and 4 with the letter "a" representing the position of components at the top of the stroke and the letter "b" representing the position of the components at the bottom of the stroke. FIG. 8 shows a longer stroke condition; FIG. 9 shows a shorter stroke condition.

Attached to the adjustment mechanism 30 or 70 is a drive mechanism 66 or 88. An input signal to the drive mechanism 66 or 88 causes the rotatable member 42 or lower threaded shaft 76 to turn, thus, moving the piston ends 36, 38 closer together or further apart from each other, and, in turn, causing the piston stroke to be varied in a controlled manner. Suitable drive mechanisms 66 or 88 can be an electric motor, gear drive or other similar mechanism. This drive mechanism is operatively attached to a sensing means (not shown) which signals the drive mechanism to adjust the piston stroke to compensate for changes in the operation of the engine such as an increase or decrease in the demand for power to the drive train of the engine, an increase or decrease in one or more exhaust components, movement of the gas pedal, or a combination of various engine parameters analyzed by the vehicle's on board computer controlled operating system. As an example, efficiency of the engine can be increased by increased displacement under high load conditions such as operation at high speeds (above 40 miles per hour in high gear), high engine rpm (greater than 2000 rpm), acceleration, climbing hills, or pulling heavy loads such as house or boat trailers.

Figure 11:
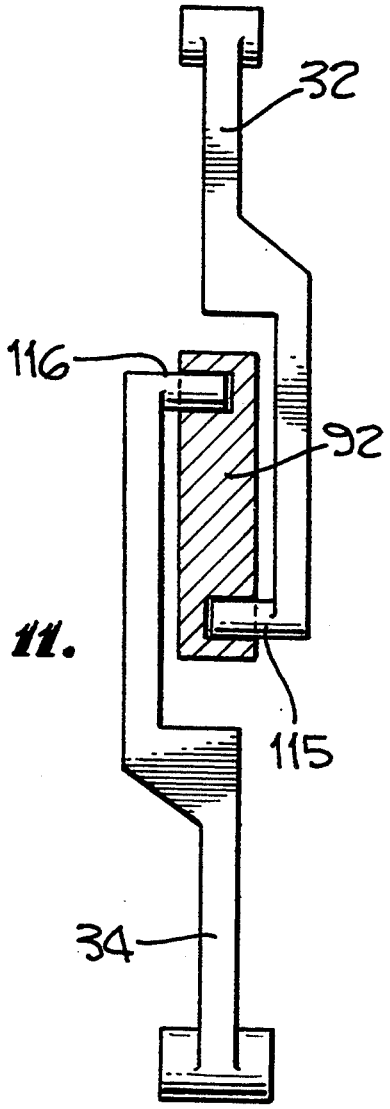
FIG. 11 is a side elevation view of the mechanism of FIG. 10.
Figure 10:
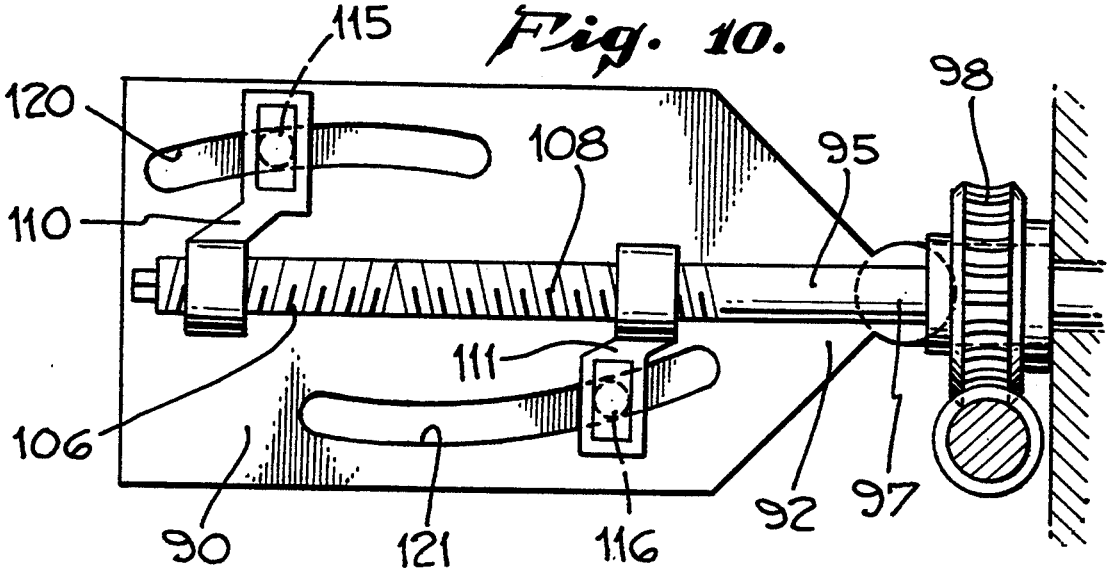
FIG. 10 is an elevation view of a piston rod adjustment means in accordance with a third embodiment of the invention.

Reference is now made to the third embodiment of the invention as shown in FIGS. 10 and 11. An elongated plate 90 is aligned in a vertical plane and has one end 92 pivotally supported from the engine frame intermediate the cylinder 10 and the crank shaft 24. An elongated shaft 95 extends lengthwise of the plate 90 and is rotatably housed therein. End 97 of shaft 95 at the end 92 of plate 90 has a gear 98 for driving the shaft in revolution. Shaft 95 has left hand threads 106 on its outer end portion and right hand threads 108 on its center portion. A shaft rider 110 rides on the left hand threads 106 while a shaft rider 111 rides on the right hand threads 108. Rider 110 has a projecting pin 115 to which the lower end of upper piston rod 32 is pivotally attached. Rider 111 has a projecting pin 116 to which the upper end of lower piston rod 34 is pivotally attached.

Of particular significance in this third embodiment is the camming action which controls lateral movements of the piston rod ends. Thus an elongated curved slot 120 is formed near the outer end of plate 90 to slidably receive the pin 115. In similar fashion an elongated curved slot 121 is formed in the lower central part of plate 90 to slidably receive the pin 116. As shaft 95 is rotatably driven from the gear 98, the shaft riders 110, 111, drive the respective pins 115, 116, along the curved slots 120, 121. In this manner the precise character of the increasing or decreasing of the effective length of the piston rod 32, 34, may be controlled in an optimum manner to meet specific design requirements.

In the embodiment of FIGS. 10 and 11 the pivoting movements and the camming movements all occur within the same plane.

The variable displacement system of the present invention incorporates several bearing surfaces which function in a manner similar to the bearing surfaces in a conventional reciprocal engine. Therefore, commercial bearing materials utilized in these type of engines are appropriate. For example, beryllium copper bearings or comparable materials can be utilized in locations which are not under high stress; lead-tin bronze or comparable materials can be used in high load locations within the engine. Additionally, the oiling system should be appropriately modified to assure that all moving contact surfaces are adequately lubricated.

For simplicity of description, the variable displacement arrangement of the invention has been described in regard to a single cylinder. However, the invention applies to a multi-cylinder engine and various arrangements of cylinders.

Although the present invention has been described in considerable detail with reference to certain preferred versions, other versions are possible. For example, it is not necessary to divide the piston rod at its center. However, the amount of adjustment of the piston displacement will vary as the ratio of the lengths of the piston rod pieces is changed. Also, various mechanisms can be interposed between the two parts of the piston rod for adjustment of the piston stroke length without departing from the concepts set forth herein. For example, the adjustment means may comprise intermeshing shafts, rods, sliding bars or a threaded mechanism incorporating a threaded shaft or double worm drive and a rider interconnected with the thread or worm. Also, while the versions set forth are directed to variation of the stroke length without change to the compression ratio, it is also contemplated that the efficiency of the engine can be further improved by varying the compression ratio as the stroke length is changed.

Therefore, the spirit and scope of the appended claims should not necessarily be limited to the description of the preferred versions contained herein.

What I claim is:

1. In an internal combustion engine having a cylinder, a piston reciprocable within the cylinder, and a crankshaft located at a fixed distance from the cylinder and driven from the piston, means for varying the piston displacement to match load requirements, comprising:

an arm having one of its ends pivotally supported in fixed relation to both the cylinder and the crank shaft in an intermediate position relative thereto, the other end of said arm carrying two oppositely threaded screws;

a piston rod divided into upper and lower portions, the upper portion having its upper end pivotally coupled to the piston and its lower end threadedly coupled to one of said two screws;

the lower piston rod portion having its lower end pivotally coupled to the crankshaft and its upper end threadedly coupled to the other of said two screws; and means for rotating said arm so as to change the effective length of the piston rod by laterally displacing the adjacent ends of the top and bottom parts of the piston rod from each other at the point of division while still transmitting energy from the piston to the crank shaft.

2. The apparatus of claim 1 wherein the piston rod is divided approximately at its center.

3. The apparatus of claim 1 wherein said two oppositely threaded screws carried by said arm are at an angle of between 20 and 40 degrees relative to each other, and have adjacent ends with intermeshing gears, one of said screws being driven by said rotating means and the other of said screws being driven by said one screw.

4. The apparatus of claim 1 which includes a frame having two camming surfaces, each of said threaded couplings being guided by a respective one of said camming surfaces.

5. In an internal combustion engine having a cylinder, a piston reciprocable within the cylinder, and a crankshaft located at a fixed distance from the cylinder and driven from the piston, means for varying the piston displacement to match load requirements, comprising:

an adjustment arm having one end pivotally attached to the engine block or frame intermediate the cylinder and the crank shaft;

a piston rod divided into upper and lower portions, the upper portion having its upper end pivotally coupled to the piston;

means pivotally coupling the lower end of the lower piston rod portion to the crankshaft;

means coupling the lower end of said upper piston rod portion to said adjustment arm;

means coupling the upper end of said lower piston rod portion to said adjustment arm;

said adjustment arm carrying oppositely oriented thread means for moving said two coupling means in opposing directions;

means associated with said arm for activating said oppositely oriented thread means so as to change the effective length of the piston rod; and the pivotal movements of said upper and lower portions of the piston rod, the pivotal movement of said adjustment arm, and the resulting lateral movements of the adjacent ends of said two piston rod portions, all occurring within the same plane.

6. The apparatus of claim 5 wherein the piston rod is divided approximately at its center.

7. The apparatus of claim 5 wherein said adjustment arm carries two oppositely threaded screws arranged at an angle of between 20 and 40 degrees relative to each other, said two screws have adjacent ends with intermeshing gears, and which further includes rotating means for driving one of said screws.

8. The apparatus of claim 5 which includes a frame having two camming surfaces, each of said coupling means being guided by a respective one of said camming surfaces.

9. In an internal combustion engine having a cylinder, a piston reciprocable within the cylinder, and a crankshaft driven from the piston, means for varying the piston displacement to match load requirements, comprising:

a piston rod divided into upper and lower portions, the upper portion having its upper end pivotally coupled to the piston;

means pivotally coupling the lower end of the lower piston rod portion to the crankshaft; and adjustment means for changing the effective length of the piston rod, said adjustment means being affixed to adjacent ends of the top and bottom parts of the divided rod through adjustable linkages, and comprising a mechanism which allows controlled lateral displacement of the top and bottom parts of the piston rod from each other at the point of division while still transmitting energy from the piston to the crank shaft;

said adjustment means including an arm having one of its ends supported in fixed relation to both the cylinder and the crank shaft in an intermediate position relative thereto, the other end of said arm carrying two oppositely threaded screws forming said adjustable linkages.

* * * * *